United States Patent [19]

Komatsu et al.

[11] Patent Number: 4,929,286

[45] Date of Patent: May 29, 1990

[54] METHOD FOR PRODUCING A GRAIN-ORIENTED ELECTRICAL STEEL SHEET

[75] Inventors: Hajime Komatsu; Mitsuro Tanino, both of Kawasaki; Yozo Suga; Toyohiko Konno, both of Kitakyushu, all of Japan

[73] Assignee: Nippon Steel Corporation, Tokyo, Japan

[21] Appl. No.: 267,729

[22] Filed: Oct. 7, 1988

Related U.S. Application Data

[62] Division of Ser. No. 883,962, Jul. 10, 1986, abandoned.

[30] Foreign Application Priority Data

Aug. 15, 1985 [JP] Japan ..... 60-179855

[51] Int. Cl.[5] ..... H01F 1/04

[52] U.S. Cl. ..... 148/111; 148/113; 148/308

[58] Field of Search ..... 148/111, 113, 308

[56] References Cited

U.S. PATENT DOCUMENTS

| | | | |
|---|---|---|---|
| 3,941,623 | 3/1976 | Takashina et al. | 148/308 |
| 4,171,994 | 10/1979 | Miller | 148/111 |
| 4,632,708 | 12/1986 | Konno et al. | 148/113 |

FOREIGN PATENT DOCUMENTS

| | | | |
|---|---|---|---|
| 999[illegible]5 | 9/1974 | Japan | 148/113 |

*Primary Examiner*—Melvyn J. Andrews

*Attorney, Agent, or Firm*—Kenyon & Kenyon

[57] ABSTRACT

In the production of a grain-oriented electrical steel sheet, instead of conventional inhibitors a novel (Al, Si)N inhibitor is utilized. This inhibitor is formed by obtaining an incomplete solution of Al and N and then nitriding the decarburization annealed steel sheet prior to initiation of a secondary recrystallization. The fine inhibitor can be formed in a large amount, thereby enhancing the magnetic flux density.

10 Claims, 4 Drawing Sheets

METHOD FOR PRODUCING A GRAIN-ORIENTED ELECTRICAL STEEL SHEET

This application is a division, of application Ser. No. 883,962 filed July 10, 1986, now abandoned.

BACKGROUND OF THE INVENTION

1. Field of the Invention

The present invention relates to a method for producing a grain-oriented electrical steel sheet. More particularly, the present invention relates to a method for producing a grain-oriented electrical steel sheet having a high magnetic flux density, by utilizing completely novel precipitates which are effective for generating the secondary recrystallization which is used as a fundamental metallurgical phenomenon for the grain-orientation. Such precipitates are referred to as the inhibitors.

2. Description of the Related Arts

Grain-oriented electrical steel sheet consists of crystal grains having the Goss orientation (expressed by the Miller index as a {110} <001> orientation), in which the {110} plane is parallel to the surface of a steel sheet and the <100> axis coincides the rolling direction. The grain-oriented electrical steel sheet is used as the core of a transformer and a generator, and must have good exciting characteristics and watt loss characteristics. The quality of the exciting characteristics is determined by the magnitude of a magnetic flux density induced in the core at a constant magnetizing force applied to the core. A high magnetic flux density is attained by aligning the orientation of crystal grains to {110} <001> at a high degree. The watt loss is a loss of power consumed as thermal energy when the core is energized by a predetermined alternating magnetic field. The quality of watt loss is influenced by magnetic flux density, sheet thickness, quantity of impurity, resistivity, grain size, and the like. Particularly, a grain-oriented electrical steel sheet having a high magnetic flux density is preferred, since the size of electrical appliances as well as the watt loss can be accordingly lessened.

Note, the grain-oriented electrical steel sheet is obtained by means of reducing the sheet thickness to a final thickness by an appropriate combination of hot-rolling, cold-rolling, and annealing, and by means of a subsequent, finishing high-temperature annealing, in which the primary recrystallized grains having {110} <001> orientation are caused to selectively grow, that is, a secondary recrystallization is effected. The secondary recrystallization is attained, when fine precipitates, such as MnS, AlN, MnSe, and the like, or an element present in the grain-boundary (hereinafter "grain-boundary element") such as Sn, S, P, and the like, are preliminarily present in the steel. As described by J.E. May and Turnbull in Trans. Met. Soc. AIME Vol. 212 (1958) pages 769/781, the precipitates and grain-boundary elements have functions, during the finishing high-temperature annealing, for suppressing a growth of primary recrystallized grains having orientations other than {110} <001> and causing a selective growth of those having {110} <001> orientation. The suppression of the crystal growth as described above is generally referred to as the inhibitor effect. Accordingly, researchers in the relevant technical field have stressed the study of the kind of precipitates or grain-boundary elements to be used to stabilize the secondary recrystallization and how to attain an appropriate existence state thereof for enhancing the proportion of accurate {110} <001> oriented grains.

With regard to the kinds of precipitates, the following disclosures have been published. M.F. Littmann in Japanese Examined Patent Publication No. 30-3651 and May and Turnbull in Transactions Metallurgical Society AIME 212 (1958) p 769/781, disclosed MnS; Taguchi and Sakakura disclosed AlN in Japanese Examined Patent Publication No. 33-4710; Fiedler disclosed VN in Transactions Metallurgical Society AIME 221 (1961) p 1201/1205; Imanaka disclosed MnSe in Japanese Examined Patent Publication No. 51-13469; and, Fast disclosed $Si_3N_4$ in Philips Search Report (1956) 11, p 490. In addition, TiS, CrS, CrC, NbC, $SiO_2$, and the like have been disclosed.

With regard to the grain boundary elements, As, Sn, Sb and the like are described in TRANSACTIONS of JAPAN INSTITUTE OF METALS 27 (1963) p 186 (Tatsuo Saito). In industrial production, the grain boundary elements are not used above but in the presence of precipitates, in an attempt to realize a supplement effect of the precipitates. For a stable industrial production of a grain-oriented electrical steel sheet and an alignment of {110} <001> orientation at a high degree, a solution is sought by determining which kinds of precipitates are to be utilized.

A criterion for selecting precipitates effective for the secondary recrystallization has not been satisfactorily elucidated. The opinion of Matsuoka described in Tetsu To Hagane 53 (1967) p 1007/1023 is representative of such criterion, and is summarized as follows.

(1) Size of approximately 0.1 μm
(2) Necessary volume of 0.1 vol% or more
(3) Neither complete solution nor complete non-solution at a temperature range of secondary recrystallization are admitted. Precipitates need to solid dissolve at an appropriate degree.

The above various precipitates satisfy the above requirements. As is apparent from the above summary, a large amount of fine precipitates must be present uniformly in the steel sheet prior to the finishing high-temperature annealing, so as to obtain a high alignment degree of {110} <001> orientation, and hence a high magnetic flux density. A number of techniques, in which components of a starting material and the conditions for heat treatment are controlled have been developed for forming such precipitates. For obtaining materials having a high magnetic flux density, it is important to control the precipitates, and in addition, to control the properties of the primary recrystallized structure by means of an appropriate combination of heat treatment, in such a manner that the recrystallized structure is adapted to the precipitates.

The grain-oriented electrical steel sheets are produced industrially, at present, by the three representative methods, all of which involve significant problems.

The first method is the dual cold-rolling method using MnS, disclosed in Japanese Examined Patent Publication No. 30-3651 by M.F. Littmann. The second method is disclosed in Japanese Examined Patent Publication No. 40-15644 by Taguchi and Sakakura, and is characterized by a heavy cold-rolling of 80% or more at the final cold-rolling and by using AlN + MnS. The third method is disclosed in Japanese Examined Patent Publication No. 51-13469 and is characterized by a double cold-rolling process with the use of MnS and/or MnSe + Sb. In all of the above methods, the heating of a slab prior to hot-rolling is carried out at a high temperature, so as to control the precipitates to be fine and uniform, such that: the slab-heating temperature employed in the first method is 1,260° C. or more; although dependent upon the Si content of the starting material, 1,350° C. is employed in the second method as described in Japanese Unexamined Patent Publication No. 48-51852; and, in the third method, as is described in Japanese Unexamined Patent Publication No. 51-20716, 1,230° C. or more is employed, and even 1,320° C. is employed in an example in which the high magnetic flux density is attained by means of dissolving the precipitates, once formed coarsely at an extremely high temperature, such as 1,320° C., into a solid solution of Si steel and then finely precipitating them during the hot-rolling or heat treatment. A high temperature heating for the slabs incurs the following problems: Energy used for heating the slabs is increased; Slags are formed, and have the yield is lessened and repairing expenses are increased. In addition, as disclosed in Japanese Examined Patent Publication No. 57-41526, a failure of the secondary recrystallization is generated when continuous cast slabs are used, that is, these slabs cannot be used for producing grain-oriented electrical steel sheets. Furthermore, as disclosed in Japanese Examined Patent Publication No. 59-7768, the failure of the secondary recrystallization mentioned above becomes more serious when the sheet thickness is further reduced.

The above methods involve further problems. In the first method, a high magnetic flux density is obtained with difficulty, and $B_{10}$ only amounts to approximately 1.86 Tesla. In the second method, appropriate production-conditions are narrowly limited in implementing industrial production, and therefore, the second method fails to stably produce products having the highest magnetic properties. The production cost is high in the third method, because it uses a double cold-rolling method and uses harmful and expensive elements, such as Sb and Se. The above methods also involve more essential and important problems than those described above. That is, in these methods, the magnetic flux density is restricted by the greatest volume of precipitates, which can be uniformly formed by these methods. More specifically, the constituting elements of the precipitates can be contained only within the solid solubility, under which the constituting elements are caused to dissolve into the solid solution of silicon steel. A method for enhancing the magnetic flux density by increasing the quantity of precipitates can therefore be carried out as long as such quantity is kept under the solid-solubility limit at slab heating.

SUMMARY OF THE INVENTION

The present invention discloses precipitates which are unknown heretofore; eliminate the necessity to add expensive elements and to once solid-dissolve them at a high temperature for the slab heating; and, are characterized by easily providing a large number of fine precipitates. It is possible, by appropriately utilizing the precipitates according to the present invention to produce, at a low cost, materials having a magnetic flux density higher than heretofore.

The present inventors discovered that (Si, Al)N precipitates have an inhibitor function for generating the secondary recrystallization. The precipitates have the following features:

(1) Majority of constitution elements of the precipitates are Si, which is present in the steel in a large amount, as well as Al, which is added to the steel in a small amount. Therefore, it is not necessary to add expensive elements so as form the precipitates, and it is easy to attain by an inexpensive means the formation of precipitates in a large amount.

(2) The solid-dissolving temperature of the precipitates is high. The precipitates, therefore, do not undergo a morphology change until the temperature is elevated to a considerable high level in the finishing high-temperature annealing. The precipitates can, therefore, contribute to the generation of a stable secondary recrystallization and to the growth of grains having an orientation close to the {110} <001> orientation.

(3) The precipitates can be formed by a very simple method. That is, the steel sheet is nitrided from outside at an intermediate step of the production process, for treating the steel containing a minute amount of solute Al. The precipitation amount can be easily controlled since the nitrogen is given to steel from the exterior thereof.

The effects of (Si, Al)N are described hereinafter with regard to embodiments of the present invention.

Slabs containing C: 0.052%, Si: 3.28%, Mn: 0.16%, S: 0.005%, P: 0.025%, acid-soluble Al: 0.028%, and T (total) N: 0.0076% were subjected to the following successive steps: heating to (A) 1150° C. and (B) 1380° C.; hot-rolling to a thickness of 1.9 mm; annealing at 1120° C. for 2 minutes; cold-rolling to a thickness of 0.20 mm; decarburization-annealing at 830° C. for 3 minutes in wet hydrogen; application of annealing separator consisting of 100 parts by weight of MgO and 5 parts by weight of MnN; and, heating to 1200° C. at a temperature-elevating rate of 10° C./hr in 10% $N_2$ + 90% $H_2$ and annealing in 100% $H_2$ for 20 hours.

The magnetic properties of the products were as follows.

(A) $B_{10}$ = 1.95 Tesla, $W_{17/50}$ = 0.75 w/kg.

(B) $B_{10}$ = 1.87 Tesla, $W_{17/50}$ = 1.12 w/kg.

MnN is added in the annealing separator. This MnN addition attains the nitridation of a steel sheet at a temperature range of from 600° to 900° C., as disclosed by several of the present inventors in Japanese Patent Application No. 59-215827. As is apparent from the results of the nitridation treatment prior to the secondary recrystallization, the magnetic flux density is high in the condition (A), in which the AlN is not solid-dissolved at the slab-heating step, and the magnetic flux density is low in the condition (B), in which complete solution is attained. These results are completely contrary to the known conventional beliefs. That is, as described in the Description of the Related Arts, a high temperature-heating of slabs for complete solution of precipitates has been recognized to be indispensable. Contrary to this, the present inventors have discovered that an extremely high magnetic flux density can be obtained by the heating condition of a slab, under which an incomplete solution of AlN is carried out. Under the condition (B), in which a solution of AlN is realized, only $B_{10}$ = 1.87 Tesla, which is merely a conventional value, is obtained.

In Japanese Examined Patent Publication No. 46-937 the nitridation of a steel sheet is carried out prior to the secondary recrystallization, but only approximately 16 $\times 10^4$ erg/cc of the torque value corresponding to $B_{10}$ of 1.80 Tesla is obtained. In this publication, the solution of AlN at the heating step of slab is alleged to be indispensable. As Japanese Examined Patent Publication No. 54-19850 indicates the necessity of suppressing the nitridation, the nitridation has heretofore been recognized to be ineffective for enhancing the magnetic flux density in the techniques in which a solution of AlN is indispensable.

In the present invention, an extremely high magnetic flux density is obtained by the nitridation treatment and incomplete solution of precipitates at the heating step of a slab, because previously unknown precipitates, i.e., (Si, Al)N-nitride of mutually solid-dissolved Si and Al, are obtained numerously and in fine form by the nitridation treatment. This is explained hereafter in more detail.

DESCRIPTION OF THE PREFERRED EMBODIMENTS

Figure 1A:
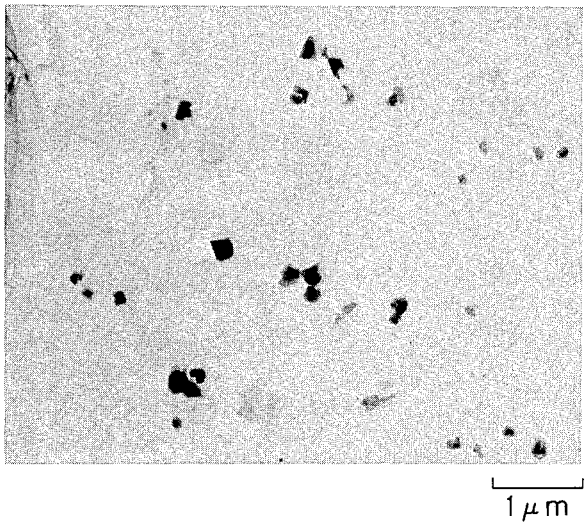
FIG. 1(A) is a photograph showing the crystal structure of precipitates (Al, Si)N according to the present invention.
Figure 1B:
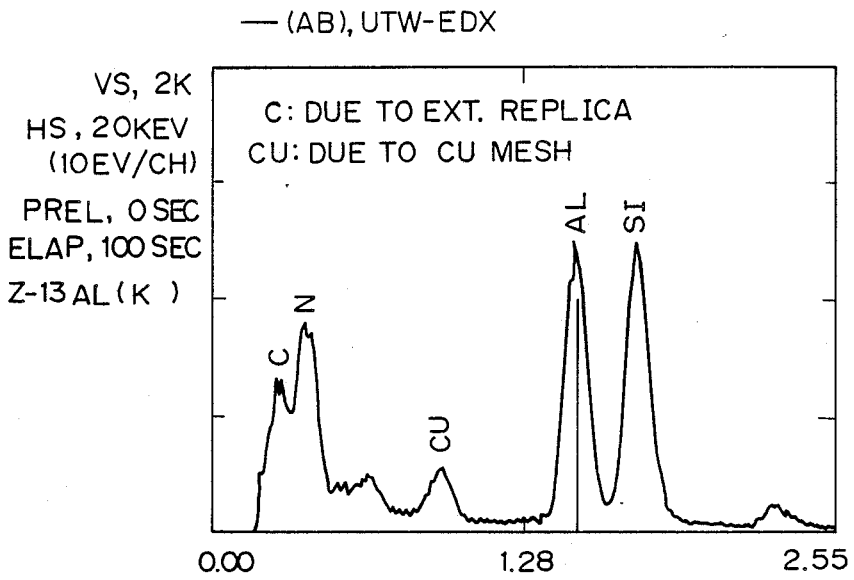
FIG. 1(B) shows the analysis result of precipitates (Al, Si)N by an analysis electron microscope (UTW-EDX)
Figure 2:
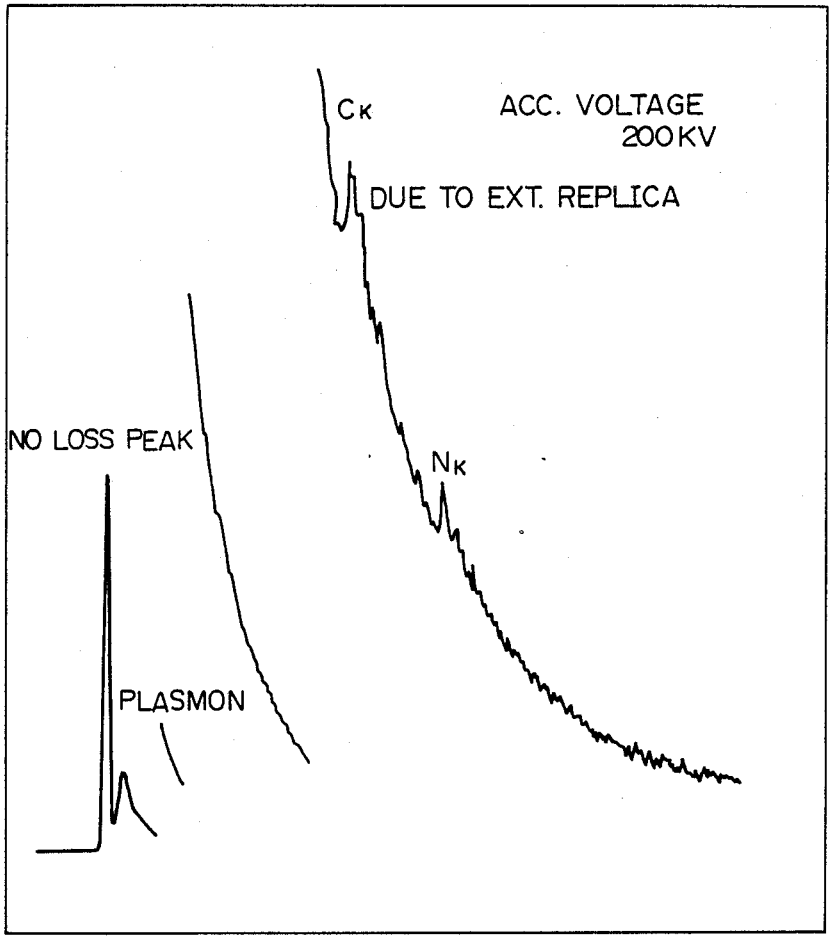
FIG. 2 shows the analysis result of the precipitates (Al, Si)N by an analysis election microscope.
Figure 3B:
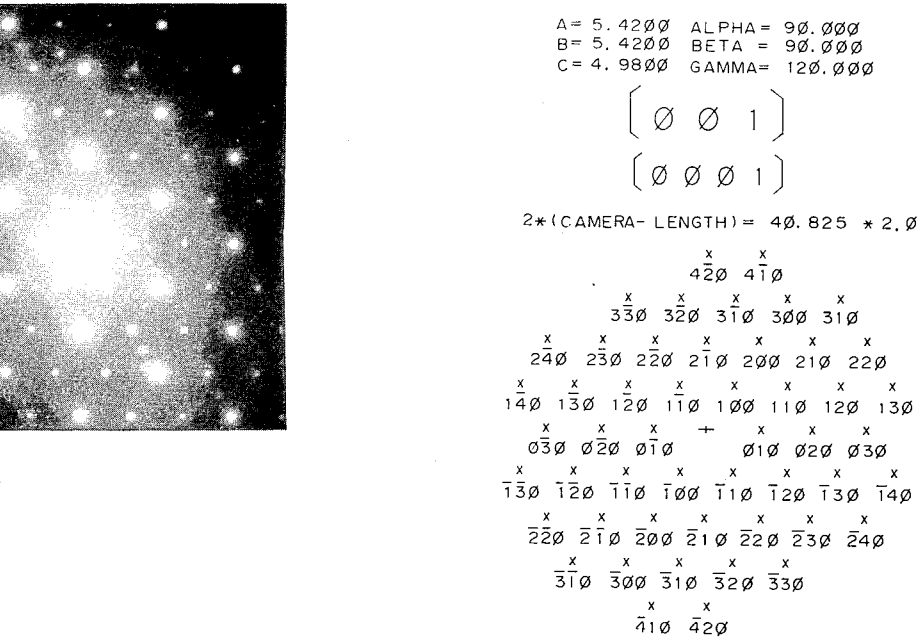
FIG. 3(A) is an electron diffraction photograph showing the crystal structure of precipitates (Al, Si)N according to the present invention; and, FIG. 3(B) shows indices of the diffraction spots.
Figure 3A:
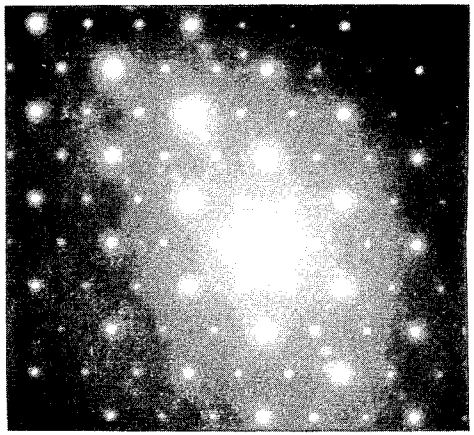

When the temperature was elevated to 850° C. in the course of finishing high-temperature annealing, the samples of steel sheets, which underwent the respective conditions (A) and (B), were withdrawn from the furnace and subjected to investigation. Chemical analysis showed a total N quantity of 148 ppm for (A) and 145 ppm for (B). Thus, the total N quantities were virtually the same as one another with regard to (A) and (B). These samples of steel sheets were subjected to observation by an electromicroscope. For the case (B), a majority of the precipitates were AlN, as previously known from, for example, Japanese Examined Patent Publication No. 46-937, and the crystal structure of the precipitates was hexagonal (a = 3.11Å, c = 4.98Å). For the case (A), the precipitates have an extremely strong characterizing structure, and virtually neither AlN nor $Si_3N_4$ are present in the precipitates. Referring to FIGS. 1(A) and (B), the precipitation morphology and analysis result by an analytical electronmicroscope EDX are shown, respectively. It can be seen that the precipitates contain Si and Al. Referring to FIG. 2, an analysis result by the electron beam energy loss spectroscopy (EELS) method using the analytical electron microscope is shown. Since nitrogen is detected in both FIG. 1(B) and FIG. 2, the precipitates are recognized to be nitrides. The electron diffraction pattern of the precipitates and its indices are shown in FIGS. 3(A) and (B), respectively. This electron diffraction pattern cannot be analyzed on the premise that the nitrides are already previously known. If the precipitates had the structure of previously known AlN, intense lights would appear only on the strong diffraction-spots of the electron diffraction-spots (indices $3\bar{3}0$, $2\bar{1}0$, 110, 030, $2\bar{4}0$, $1\bar{2}0$, and the like), and no diffraction spots would have appeared on the weak spots between the strong spots. In addition, the diffraction pattern shown in FIG. 3(A) is not coincident with any of already known Si nitrides, i.e., $\alpha$-$Si_3N_4$ and $\beta$-$Si_3N_4$. It is, therefore, clear that none of the precipitates are the already known AlN, $\alpha$-$Si_3N_4$, and $\beta$-$Si_3N_4$ but are a novel nitride phase.

As described hereinabove, the precipitates discovered are (Si, Al)N-nitride of Si and Al which are mutually solid-dissolved. The weight proportion of Si and Al ranges from approximately 1:2 to 2:1. An extremely minor quantity of Mn may be occasionally contained in (Si, Al)N, but the fundamental structure of the nitride is (Si, Al)N.

The discovery made by the present inventors resides in the fact that, when the starting material slab slightly containing Al and N, and is heated so as not to attain a complete solution of Al and N, and is subsequently subjected to a nitridation treatment, (Si, Al)N precipitates are formed but not the already known $Si_3N_4$ and AlN, and products having an extremely high magnetic flux density are stably obtained by utilizing these precipitates.

Three slabs containing C: 0.050%, Si: 3.35%, Mn: 0.13%, S: 0.005%, and P: 0.020%, and further, containing (1) Al: 0.030% and N: 0.0070%, (2) Al: 0.020% and N: 0.0060%, or (3) Al: 0.027% and N: 0.0065%, were subjected to the successive steps of: heating to a temperature range of from 1050° to 1420° C.; hot-rolling to a thickness of 1.9 mm; annealing at 1120° C. for 2 minutes; cold-rolling to a thickness of 0.20 mm; decarburization-annealing at 850° C. for 90 seconds in wet hydrogen; application of annealing separator consisting of MgO and 5% by weight of ferromanganese nitride; and, finishing high temperature-annealing at 1200° C. for 20 hours. The magnetic properties of the products are shown in Table 1.

TABLE 1

| | Components | | Slab Heating | | | | | | | | | | | | Solid-Dissolving Temperature |
|---|---|---|---|---|---|---|---|---|---|---|---|---|---|---|---|
| | | | 1100° C. | | 1150° C. | | 1200° C. | | 1250° C. | | 1350° C. | | 1420° C. | | |
| | | | Magnetic Properties | | | | | | | | | | | | |
| | Al | N | $B_8$ (T) | $W_{17/50}$ (W/kg) | $B_8$ (T) | $W_{17/50}$ (W/kg) | $B_8$ (T) | $W_{17/50}$ (W/kg) | $B_8$ (T) | $W_{17/50}$ (W/kg) | $B_8$ (T) | $W_{17/50}$ (W/kg) | $B_8$ (T) | $W_{17/50}$ (W/kg) | |
| 1 | 0.030% | 0.0070% | 1.98 | 0.72 | 1.98 | 0.73 | 1.96 | 0.75 | 1.94 | 0.83 | 1.89 | 1.07 | 1.86 | 1.19 | 1310 |
| 2 | 0.020% | 0.0060% | 1.93 | 0.79 | 1.93 | 0.79 | 1.92 | 0.80 | 1.92 | 0.87 | 1.86 | 1.17 | 1.86 | 1.21 | 1230 |
| 3 | 0.027% | 0.0065% | 1.94 | 0.76 | 1.93 | 0.78 | 1.93 | 0.79 | 1.92 | 0.86 | 1.87 | 1.11 | 1.87 | 1.13 | 1280 |

In Table 1, the temperature at which a complete solution of AlN occurs is shown for the respective starting material slabs.

When the heating temperature of the slabs is higher than the complete solution temperature, the magnetic flux density ($B_{10}$)lies in the range of from 1.86 to 1.89 Tesla, and is virtually constant. On the other hand, when the heating temperature of the slabs is lower than the complete solution temperature, the magnetic flux density ($B_{10}$) exhibits a high value of from 1.92 to 1.98 Tesla. When the steel sheet samples, which underwent an incomplete solution of AlN, were withdrawn from a furnace upon a temperature elevation of up to 850° C. in the finishing high temperature annealing, and then subjected to an investigation of structure, a number of (Si, Al)N precipitates were detected in the steel sheet samples. It is not clear why the (Si, Al)N precipitates under the condition of an incomplete solution of AlN. Presumably, the solute Al is present uniformly and in a large quantity in the case of a complete solution of AlN, with the result that requisite diffusion distance of Al atoms for forming an Al compound is short, and hence the solute Al atoms easily gather around the intruded N atoms to form AlN. Contrary to this, in the case of an incomplete solution of AlN, the requisite diffusion distance of Al atoms for forming an Al compound is presumably long, with the result that Al atoms are deficient for forming AlN, and instead of Al, Si, which is abundantly present in the steel, is caused to be contained in the nitrides.

The method according to the present invention is described hereinafter in more detail.

With regard to the components of the starting material, the inclusion of Si and Al in the starting material is indispensable because (Si, Al)N is used as the precipitates required for the secondary recrystallization. When the Si content is less than 1.5%, the dual, $\alpha + \Theta$ phases are formed at the finishing high-temperature annealing, and the orientation of the secondary recrystallization does not align. On the other hand, when the Si content exceeds 4.5%, serious cracking occurs during the cold-rolling. The Si content is therefore from 1.5 to 4.5%. When the Al content is extremely low, the solution temperature of AlN, and hence the heating temperature of the slab, become excessively low so that a shape failure occurs during the hot-rolling. The solution temperature of AlN determined by the product of Al and N contained in the steel. For example, the Journal of Magnetism and Magnetic Materials 19 (1980) p 15/17 shows $\log [Al\%] [N\%] = -10062/T + 2.72$.

T is a solution temperature (K) of AlN.

The temperature for an incomplete solution, i.e., partial solution, of AlN at the slab heating can be determined by the above equation, taking into consideration of the desired hot-rolling temperature. Generally speaking, when the hot-rolling temperature is exceedingly low, it becomes difficult to ensure the shape of the steel sheets. The lowest hot-rolling temperature under which the shape failure is likely to occur is usually approximately 1000° C. On the other hand, when the hot-rolling temperature is exceedingly high, the oxidation and melting of the slab surface is so accelerated as to form slag. Desirably, the hot-rolling temperature is 1270° C. or less, at which slag does not form. An appropriate temperature range of slab is from 1000° to 1270° C. A temperature of an incomplete solution within this range is determined by the Al and N contents.

When the N content exceeds 0.0095%, the swells referred to as blistering are likely to form on steel sheets. The N content is therefore preferably determined at 0.0095% or less. It is preferred that upon determination of the N content, the Al content is then determined so as to attain an incomplete solution of AlN.

The elements other than Si and Al need not be specified.

The quantity of oxide-based inclusions and sulfide-based inclusions should be as small as possible, since the solute Al precipitates around these inclusions precipitated during the hot-rolling, and thus Al for subsequently forming (Si, Al)N by nitridation is consumed by such precipitation. It is, however, difficult to decrease, by means of the refining techniques at present, the oxide-based inclusions to a level at which the Al consumption will not occur at all. The S content is not specifically limited but is preferably 0.007% or less because of the following. Namely, it is possible to decrease the S content to a level such that the Al consumption virtually will not occur at all, since $S \leqq 0.007\%$ can be attained by the present refining techniques and leads to a drastic decrease of the sulfide-based inclusions.

The molten steel containing the above components can be refined by a converter, an electric furnace, an open hearth furnace, and any other refining furnaces.

The linear failure in the secondary recrystallization (referred to as the streaks) is not generated at all according to the present invention. The continuous casting method, in which the streaks are liable to occur, is advantageously applied for forming the slabs.

The hot-rolled strips must be annealed. The annealing is a continuous type with a short annealing time. The annealing temperature is desirably in a range of from 900° to 1150° C. Within this temperature range, the higher the temperature, the higher the magnetic flux density.

The annealed strip is then cold-rolled. If necessary, the cold-rolling may be carried out a plurality of times, with an intermediate annealing between the cold-rolling steps. However, a satisfactorily high magnetic flux density $B_{10}$ can be obtained by only a single cold-rolling. The higher the rolling ratio of the final cold-rolling, the higher the magnetic flux density $B_{10}$. The magnetic flux density $B_{10}$ of 1.92 Tesla or more can be easily obtained at the rolling ratio of a final cold-rolling exceeding 87%.

Conventionally, the production of 0.28 mm or less gauge steel incurs the problem of streaks. According to the present invention, even at such a thin gauge, the problem of streaks does not occur at all. The present invention is furthermore significant when applied for the production of thin gauge steel.

The cold-rolled strip having the thickness of a final product is decarburization annealed within wet hydrogen. The annealing time may be short. The annealing separator is applied on the decarburization-annealed sheet which is then finishing annealed.Finish annealing is carried out for purposes of secondary recrystallization and purification. The annealing temperature is high and the annealing time is long. In order to attain the presence of (Si, Al)N precipitates prior to the secondary recrystallization, the decarburization-annealed steel sheet is annealed for a short period of time within an atmosphere having a nitriding capacity. Alternatively, the decarburization-annealed steel sheet is nitrified during the temperature-elevation stage of the finishing high-temperature annealing. In the latter method, since the steel sheet is annealed while it is coiled, and thus laminated, a compound having a nitriding ability and hence, the uniform nitridation by the annealing atmosphere is impossible, should be added to the annealing separator.

The present invention is hereinafter described by way of examples.

EXAMPLE 1

A slab containing C: 0.053%, Si: 3.35%, Mn: 0.14%, S: 0.006%, P: 0.030%, Al: 0.032%, and N: 0.0076% were subjected to the following successive steps: heating to (A) 1150° C. and (B) 1410° C.; hot-rolling to a thickness of 1.8 mm; annealing at 1120° C. for 2 minutes; cold-rolling once to a thickness of 0.20 mm; decarburization-annealing at 850° C. for 70 seconds in wet hydrogen; application of annealing separator consisting MgO and 5% by weight of MnN; and, heating to 1200° C. at a temperature-elevating rate of 10° C./hr and annealing at 1200° C. for 20 hours.

The magnetic properties of the products were as follows (A) $B_{10}$ = 1.96 Tesla, $W_{17/50}$ = 0.73 w/kg (B) $B_{10}$ = 1.89 Tesla, $W_{17/50}$ = 1.11 w/kg

EXAMPLE 2

The decarburization annealed sheet of Example 1 was heated at 650° C. for 3 minutes in a nitrogen atmosphere containing 5%$NH_3$, and then MgO as the annealing separator was applied on the sheet annealed in the nitrogen atmosphere. The magnetic properties of the products were as follows.

(A) $B_{10}$ = 1.93 Tesla, $W_{17/50}$ = 0.82 w/kg (B) $B_{10}$ = 1.88 Tesla, $W_{17/50}$ = 1.16 w/kg

EXAMPLE 3

A slab containing C: 0.049%, Si: 3.60%, Mn: 0.18%, S: 0.003%, P: 0.003%, Al: 0.026%, and N: 0.0060% were subjected to the following successive steps: heating to (A) 1050° C. and (B) 1410° C.; hot-rolling to a thickness of 2.3 mm; annealing at 1120° C. for 2 minutes; cold-rolling once to a thickness of 0.23 mm; decarburization-annealing at 850° C. for 90 seconds in wet hydrogen; application of an annealing separator consisting of MgO and 5% by weight of MnN; and, heating to 1200° C. at a temperature-elevating rate of 10° C./hr and annealing at 1200° C. for 20 hours.

The magnetic properties of products were as follows.

(A) $B_{10}$ = 1.95 Tesla, $W_{17/50}$ = 0.83 w/kg (B) $B_{10}$ = 1.88 Tesla, $W_{17/50}$ = 1.18 w/kg

We claim:

1. In a method for producing a grain-oriented electrical steel sheet having a high magnetic flux density, said method including the steps of:

providing a silicon steel slab containing from 1.5 to 4.5% Si as well as Al and N;

hot rolling said slab to provide a hot rolled strip;

annealing said hot rolled strip;

cold rolling said hot rolled strip once or twice to produce a cold roll strip having a final sheet thickness;

decarburization annealing said strip after cold rolling;

applying an annealing separator to said strip after said decarburization annealing; and thereafter, finish annealing said strip to carry out secondary recrystallization and purification;

the improvement comprising:

heating said slab prior to hot rolling to a temperature at which incomplete solution of Al and N occurs;

nitriding said strip after said decarburization annealing and prior to initiation of secondary recrystallization in said finishing annealing step thereby forming precipitates of (Si, Al)N, said precipitates causing said secondary recrystallization.

2. A method according to claim 1 wherein the N content of said silicon steel slab is 0.0095% or less.

3. A method according to claim 1 further comprising heating said silicon steel slab prior to hot rolling to a temperature of 1270° C. or less.

4. A method according to claim 2 further comprising heating said silicon steel slab prior to hot rolling to a temperature of 1270° C. or less.

5. A method according to claim 3 further comprising heating said silicon steel slab prior to hot rolling to a temperature of more than 1000° C.

6. A method according to claim 4 further comprising heating said silicon steel slab prior to hot rolling to a temperature of more than 1000° C.

7. A method according to claim 5 comprising providing said slab with a selected N content and a selected Al content resulting in incomplete solution of Al and N during said heating of said slab at a selected temperature prior to hot rolling.

8. A method according to claim 6 comprising providing said slab with a selected N content and a selected Al content resulting in incomplete solution of Al and N during said heating of said slab at a selected temperature prior to hot rolling.

9. A method according to claim 1 comprising applying an annealing separator containing MgO and a compound having nitriding ability.

10. A method according to claim 1 further comprising:

annealing said strip in a nitriding atmosphere prior to applying said annealing separator to said strip.

* * * * *

UNITED STATES PATENT AND TRADEMARK OFFICE

CERTIFICATE OF CORRECTION

PATENT NO. : 4,929,286

DATED : May 29, 1990

INVENTOR(S) : H. Komatsu et al

It is certified that error appears in the above-identified patent and that said Letters Patent is hereby corrected as shown below:

On the title page, item [75] Inventors: delete "Mitsuro" and insert --Mitsuru--.

Signed and Sealed this

Twenty-second Day of September, 1992

*Attest:*

DOUGLAS B. COMER

*Attesting Officer*

*Acting Commissioner of Patents and Trademarks*